US005884330A

United States Patent [19]

Erlich

[11] Patent Number: 5,884,330

[45] Date of Patent: Mar. 23, 1999

[54] GARMENT SHIELD

[76] Inventor: Laura Erlich, 19 Fox Run Rd., Bedford, Mass. 01730

[21] Appl. No.: 3,398

[22] Filed: Jan. 6, 1998

[51] Int. Cl.[6] ..... A41D 27/13

[52] U.S. Cl. ..... 2/53; 2/54; 2/58

[58] Field of Search ..... 2/46, 48, 49, 50, 2/51, 52, 49.1, 49.2, 49.3, 49.4, 49.5, 174, 406, 53, 54, 55, 56, 57; 604/385.2

[56] References Cited

U.S. PATENT DOCUMENTS

| | | | |
|---|---|---|---|
| 1,541,054 | 6/1925 | Kamm | 2/58 X |
| 2,344,781 | 3/1944 | Mullen | 2/53 |
| 2,747,193 | 5/1956 | Pulsifer | 2/56 |
| 2,818,572 | 1/1958 | Oliver | 2/55 |
| 3,588,916 | 6/1971 | Glatt | 2/53 |
| 3,727,237 | 4/1973 | Glatt | 2/56 |
| 3,885,247 | 5/1975 | Kost | 2/55 |
| 3,934,004 | 1/1976 | Orren | 424/68 |
| 4,381,611 | 5/1983 | Wishman | 34/9 |
| 4,393,521 | 7/1983 | Jones | 2/56 |
| 4,545,080 | 10/1985 | Gorham | 2/54 |
| 4,631,752 | 12/1986 | Heyman et al. | 2/56 |
| 4,663,780 | 5/1987 | Rawlings et al. | 2/53 |
| 4,747,162 | 5/1988 | Yanagihara | 2/53 |
| 5,042,088 | 8/1991 | Sherrod et al. | 2/53 |
| 5,103,500 | 4/1992 | Nager et al. | 2/56 |
| 5,154,715 | 10/1992 | Van Iten | 604/387 |
| 5,221,275 | 6/1993 | Van Iten | 604/387 |

*Primary Examiner*—Jeanette Chapman
*Attorney, Agent, or Firm*—Jacob N. Erlich

[57] ABSTRACT

A garment shield for preventing an underarm portion of a garment from being damaged or becoming unsightly as a result of perspiration. The shield has an absorbent layer of material, the absorbent layer of material being of a predetermined length and a predetermined width and being foldable substantially midway along the length thereof. The absorbent layer of material having oppositely opposed indentations at peripheral edges of the width at substantially where the shield is folded, and the indentations preferably being void of any sharp edges. A plurality of spreadable incisions are located in the absorbent layer of material, with each of the incisions extending radially inward from the peripheral edge of the shield and spaced apart from one another along the peripheral edge, and the indentations being void of any of the incisions. An adhesive is affixed to an undersurface of the absorbent layer of material for removably adhering the absorbent layer of material to the underarm portion of the garment and acting as a barrier to substantially prevent moisture from passing therethrough and onto the garment.

20 Claims, 4 Drawing Sheets

GARMENT SHIELD

BACKGROUND OF THE INVENTION

This invention relates generally to clothing protectors and, more particularly to a lightweight absorbent garment shield for use in conjunction with the underarm area of a woman's or man's garment in order to prevent the garment from being damaged by perspiration and for avoiding the unsightliness of perspiration stain.

There are various types of clothing shields available to protect the underarm area of clothing from perspiration. Generally these shields are made up of an absorbent material backed by a liner with an adhesive attached to the liner for adhering the shield to the underarm portion of a garment.

These past shields, although generally effective in preventing perspiration damage to the garment, have numerous drawbacks associated therewith. For example, many of the current shields are bulky in design. This bulkiness can cause discomfort to the wearer. In addition, past shields have failed to fit snugly under the garment causing unsightly bulges beneath the garment and therefore, in many instances may be visible therethrough. It is therefore evident that there still exists a need for a more effective garment shield.

It is therefore an object of this invention to provide an extremely lightweight garment shield.

It is another object of this invention to provide a streamlined and thin garment shield.

It is still another object of this invention to provide a flexible garment shield which is easily contoured to the underarm area of a garment.

It is another object of this invention to provide a disposable garment shield.

It is another object of this invention to provide a garment shield which contains alignment means thereon.

SUMMARY OF THE INVENTION

The garment shield of this invention overcomes the problems encountered in past garment shields and meets the above objects in a novel manner.

The garment shield of the present invention has a substantially circular, oval, square or rectangular configuration with opposed indentations devoid of sharp edges and a plurality of spaced apart slits or incisions which permit the garment shield to be used effectively with any type of garment. In addition, the use of a minimum number of elements, in conjunction with a minimum amount of substantially odorless adhesive permits the shield of this invention to be virtually unnoticeable under a garment. Another feature of this invention involves the utilization of a centering mark associated with the garment shield to enable the shield to be easily centered with respect to the underarm area of the garment.

The garment shield of this invention incorporates therein a layer of absorbent material comprising of a soft lightweight thermal bonded web formed on a nonwoven carrier. The thermal bonded web would permit moisture to pass therethrough and keep the skin dry while the nonwoven carrier would absorb moisture.

For a better understanding of the present invention, together with other and further objects thereof, reference is now made to the following description taken in conjunction with the accompanying drawings and claims.

DETAILED DESCRIPTION OF THE PREFERRED EMBODIMENTS

Figure 1:
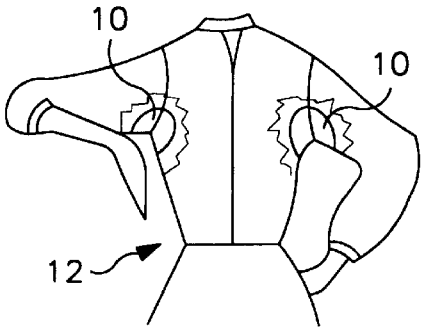
FIG. 1 is a pictorial illustration of the positioning of the garment shield of this invention underneath the garment.
Figure 2:
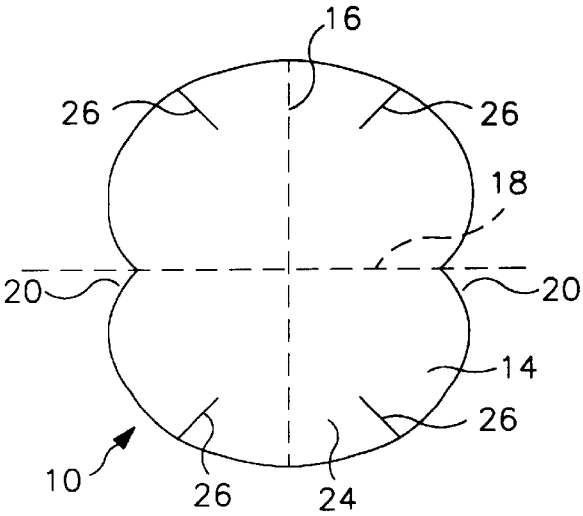
FIG. 2 is a bottom view of one embodiment of the garment shield of this invention showing a plurality spreadable incisions therein.

Reference is now made to FIG. 1 of the drawings which discloses the placement of a pair of garment protectors or shields 10 of this invention in place on the inside surface of the underarm area of a garment 12. Although garment 12 is shown in FIG. 1 as a dress it may be in the form of any woman's or man's garment in which protection from underarm perspiration is desired. Further, for ease of understanding the descriptions of the various embodiments of the garment shield or protector of this invention, identical reference numerals will be utilized to identify similar components and portions of the various embodiments Reference is now made to FIGS. 1–5 of the drawings for a detailed description of one of the preferred embodiments of the garment shield of this invention, More specifically, each garment protector or shield 10 of this invention is made up of a substantially elongated oval or substantially circular configured layer of absorbent material 14 (shown in cross-section, in FIG. 5). An example of a preferred material for the layer of absorbent material 14 would be a soft lightweight thermal bonded web formed on a nonwoven carrier. The thermal bonded web would permit moisture to pass therethrough and keep the skin dry while the nonwoven carrier would absorb moisture. The absorbent layer of material 14 preferably has a larger vertical length 16 than the horizontal width 18, with the horizontal length 18 having oppositely opposed curved indentations 20 at opposed peripheral edges of shield 10. For example, the vertical length would be preferably less than 10 inches and the horizontal length preferably less than 8 inches. However, other dimensions within the scope of this invention could also be used.

Figure 3:
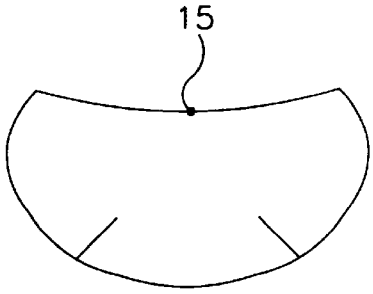
FIG. 3 is a top side view of one embodiment of the garment shield in its folded position.
Figure 5:
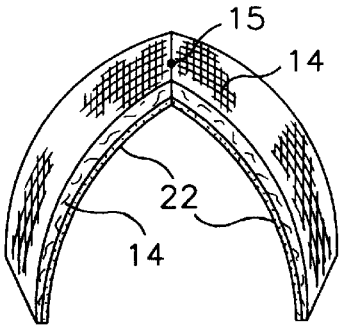
FIG. 5 is a pictorial cross-section view of one embodiment of the garment shield of this invention.

These curved indentations 20 are preferably made without any sharp edges in order to fit snugly beneath the underarm of a garment 12 without pinching the user. Referring to FIG. 3 and 5 of the drawings, a center mark in the form of a dot 15 or arrow or other such mark is imprinted on the outside surface of the center of the absorbent layer of material 14 midway between the curved indentations 20 in order to assist the wearer in properly placing the shield 10 along the inner seam of the underarm portion of a garment. The wearer utilizes this mark 15 in conjunction with the curved indentations to properly center the shield in place.

Figure 4:
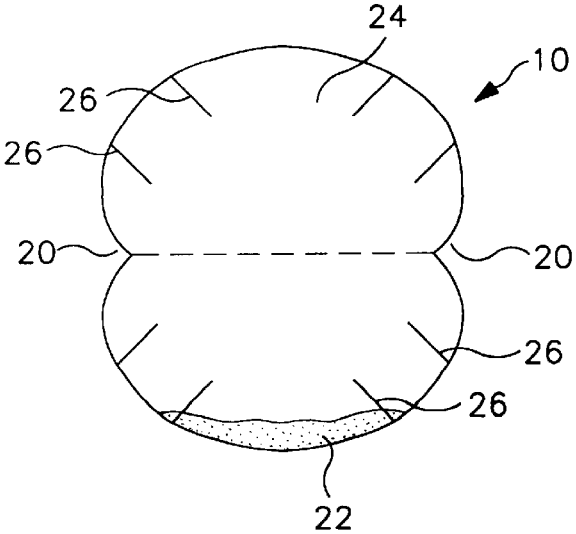
FIG. 4 is a bottom view of one embodiment of the garment shield showing eight spreadable incisions and the adhesive covering upturned at its edge exposing part of the adhesive.

As shown in FIG. 4 of the drawings, an entire undersurface of absorbent material 14 is coated with an adhesive film or tape 22 which not only enables the shield 10 to removably adhere to the underarm portion of a garment 12, but also acts as a barrier to substantially prevent the moisture or perspiration from passing onto the garment 12. The use of only an adhesive film or tape 22 with the absorbent layer of material 14 enables the protector 10 of this invention to be extremely flexible and when folded as shown in FIGS. 3 and 5 of the drawings remains in a substantially folded position without the need for creases or scoring of the material, a process step which adds to the expense of manufacture.

It should be also understood that if such a double-faced tape 22 is used with this invention the side of the tape attached to the material 14 would have a stronger adhesive capability than the side which is attached to the garment. In addition, the use of a minimum of elements makes shield 10 extremely light weight and virtually unnoticeable under a garment. There are no intermediate layers of material to add rigidity to the shield 10.

An example of the type of adhesive film or tape used with the garment protector 10 of this invention could be a double faced tape in which the adhesive is substantially odor free. Furthermore, the adhesive should be of the type which adheres to the cloth material of a garment yet when removed leaves virtually no adhesive substance on the cloth garment.

Still referring to FIGS. 2–5 of the drawings, the layer of material 14 and the thin removable (peelable) paper or cloth adhesive cover 24 have a plurality of spreadable incisions 26 located therein extending radially inward from the peripheral edges of the shield 10. These incisions, preferably 4 in number, permit the absorbent layer of material 14 to conform to the underarm portion of various sized garments 12 without creating a "bunching up" of the material. This makes shield 10 extremely comfortable for the user and prevents unsightly bulges beneath the garment.

It should also be realized that these spreadable incisions 26 are necessary within the layer of absorbent material 14 but are optional within the peelable cover 24. The method of manufacture dictates whether the incisions 26 are only in the absorbent layer of material 14 or in both the peelable cover 24 and the absorbent material 14.

Figure 6:
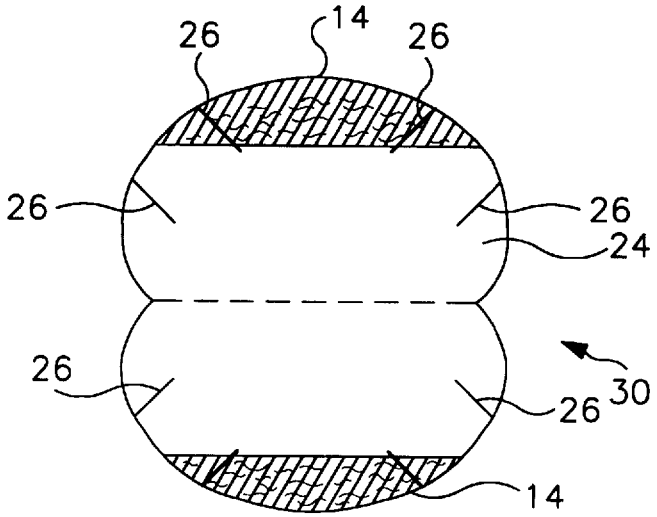
FIG. 6 is a bottom view of one embodiment of the garment shield showing a modified adhesive covering.
Figure 7:
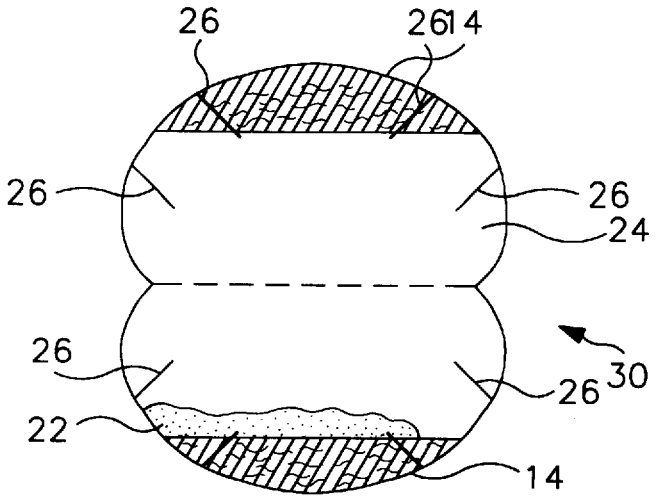
FIG. 7 is a bottom view of the garment shield of FIG. 6 showing the modified adhesive covering upturned at the edge exposing part of the adhesive.

FIGS. 6 and 7 of the drawings show another embodiment of this invention wherein shield 30 has an adhesive film or tape 22 only covering a portion of a under surface of absorbent material 14. In this embodiment, the adhesive film or tape covers at least ¾ of the surface since the adhesive film or tape not only serves as an adhesive but also as a perspiration/moisture barrier.

Figure 8:
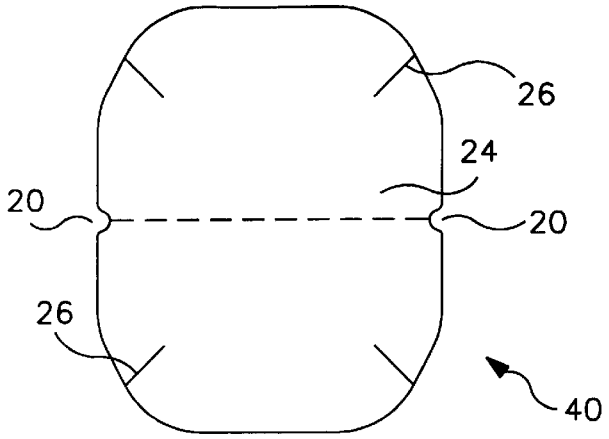
FIG. 8 is a bottom view of another embodiment of the garment shield of this invention showing a plurality spreadable incisions therein.
Figure 9:
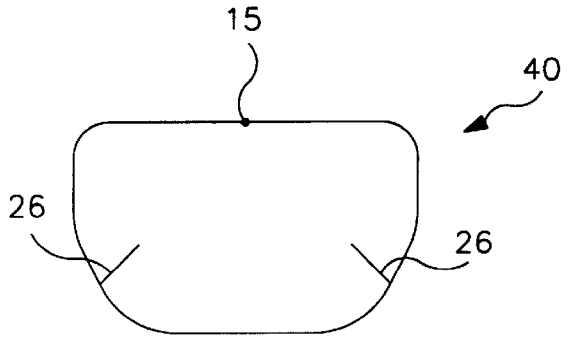
FIG. 9 is a top side view of the garment shield in its folded position.
Figure 10:
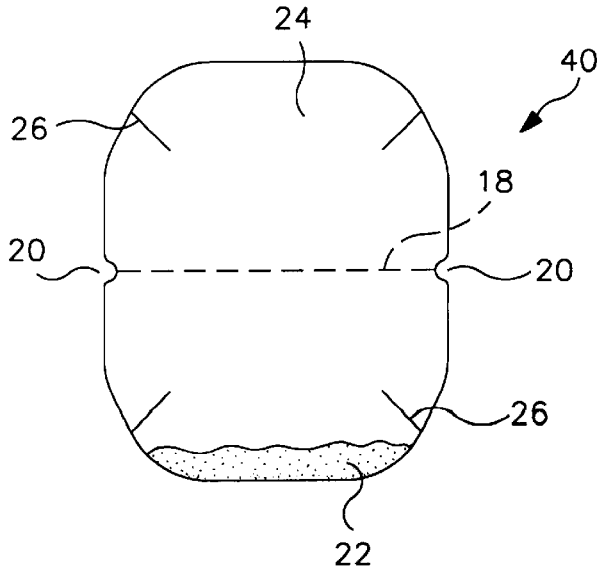
FIG. 10 is a bottom view of another embodiment of the garment shield showing four spreadable incisions and the adhesive covering upturned at its edge exposing part of the adhesive.
Figure 11:
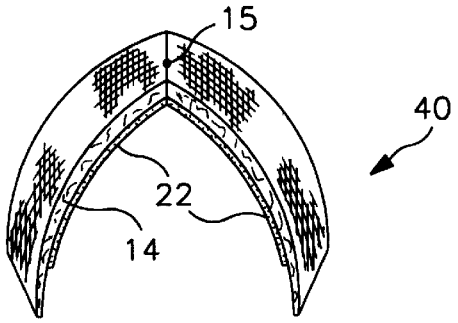
FIG. 11 is a pictorial cross -section view of another embodiment of the garment shield of this invention.
Figure 12:
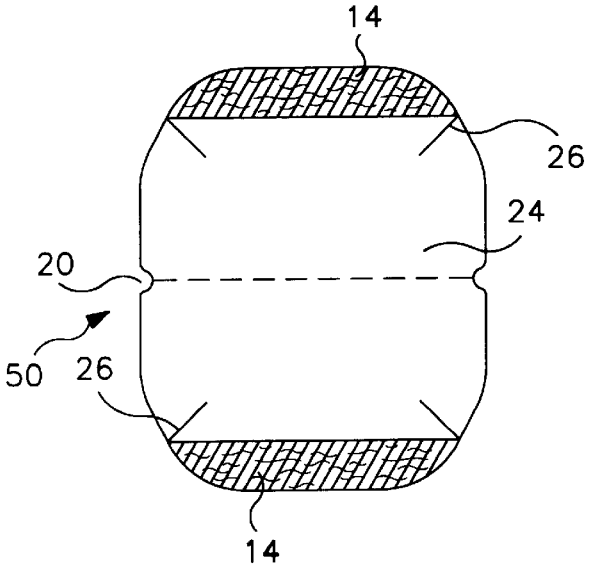
FIG. 12 is a bottom view of another embodiment of the garment shield showing a modified adhesive covering.
Figure 13:
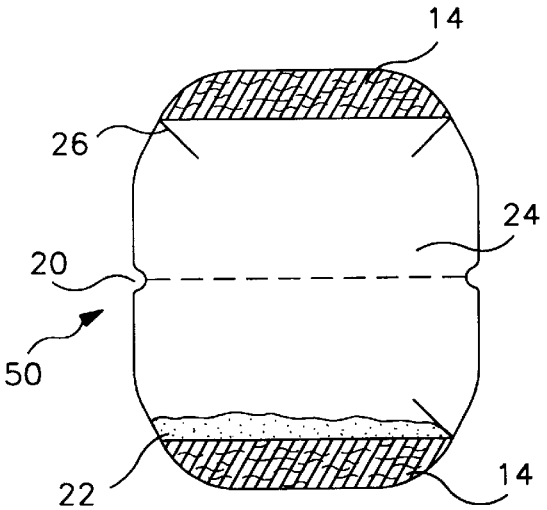
FIG. 13 is a bottom view of the garment shield of FIG. 12 showing the modified adhesive covering upturned at the edge exposing part of the adhesive.

Reference is now made to FIGS. 8–13 of the drawings for a further embodiment of this invention. For example, shields 40 and 50 have overall configurations which vary slightly from the configurations of the embodiments of shields 10 and 30. These configurations may be substantially square as shown in FIGS. 8 and 10 or substantially rectangular as shown in FIGS. 10 and 13. The actual vertical and horizontal dimensions however, would still be substantially identical to the dimensions provided above with respect to shields 10 and 30. Also, the other remaining components of shields 40 and 50 would be virtually identical to the embodiments shown in FIGS. 1–7. Therefore, similar components of shields 40 and 50 to those of shields 10 and 30 will be referred to by identical reference numerals.

It is also essential that all shields 10, 30, 40 and 50 be extremely thin, since the thickness of the absorbent layers of material 14 will add to the bulkiness of the shield. For example, the absorbent layer of material 14 should preferably be approximately 1–5 mm in thickness and the spreadable incisions 26 should be approximately 0.5–2 cm in radial length.

Although this invention has been described with reference to particular embodiments, it will be understood to those skilled in the art that this invention is also capable of a variety of other and further embodiments within the spirit and scope of the appended claims.

I claim:

1. A garment shield for preventing an underarm portion of a garment from being damaged or becoming unsightly as a result of perspiration, said shield comprising:

an absorbent layer of material, said absorbent layer of material having a predetermined length and a predetermined width and being foldable substantially midway along the length thereof;

said absorbent layer of material having oppositely opposed indentations at peripheral edges of said width at substantially where said shield is folded;

means affixed to an undersurface of said absorbent layer of material for removably adhering said absorbent layer of material to the underarm portion of the garment and acting as a barrier to substantially prevent moisture from passing therethrough and onto the garment; and a plurality of spreadable incisions located in said absorbent layer of material and said adhering and moisture barrier means, each of said incisions extending radially inward from the peripheral edge of said shield and spaced apart from one another along said peripheral edge, and said indentations being void of any of said incisions, wherein said incisions permit said absorbent layer of material to conform to the underarm portion of various sized garments.

2. The garment shield as defined in claim 1 further comprising a centering mark imprinted on an outer surface of said absorbent layer of material and located midway along said width where said shield is folded, said centering mark being used in conjunction with said indentations to align said shield along the underarm portion of the garment.

3. The garment shield as defined in claim 1 wherein said adhering and moisture barrier means comprises a double faced tape having an adhesive on both sides thereof, said adhesive being of greater adhesive strength on the side which adheres to said absorbent layer of material than said side which adheres to the garment.

4. The garment shield as defined in claim 2 wherein said adhering and moisture barrier means comprises a double faced tape having a substantially odorless adhesive on both sides thereof, said adhesive being of greater adhesive strength on the side which adheres to said absorbent layer of material than said side which adheres to the garment.

5. The garment shield as defined in claim 4 further comprising removable means for covering said adhesive prior to adhering said shield to the underarm portion of the garment.

6. The garment shield as defined in claim 1 wherein there are at least four of said spreadable incisions, each of said incisions being approximately 0.5–2 cm in length.

7. The garment shield as defined in claim 1 wherein said absorbent layer of material is approximately 1–5 mm in thickness.

8. The garment shield as defined in claim 7 wherein said absorbent layer of material is made of a soft, lightweight thermal bonded web formed on a nonwoven carrier.

9. The garment shield as defined in claim 3 wherein said adhesive tape covers substantially all of said undersurface of said absorbent layer of material.

10. The garment shield as defined in claim 3 wherein said adhesive tape covers at least substantially three quarters of said undersurface of said absorbent layer of material.

11. The garment shield as defined in claim 6 further comprising a centering mark imprinted on an outer surface of said absorbent layer of material and located midway along said width where said shield is folded, said centering mark being used in conjunction with said indentations to align said shield along the underarm portion of the garment.

12. The garment shield as defined in claim 1 wherein said predetermined length is less than 10 inches and said predetermined width is less than 8 inches.

13. The garment shield as defined in claim 4 wherein said absorbent layer of material is made of a soft, lightweight thermal bonded web formed on a nonwoven carrier.

14. The garment shield as defined in claim 13 wherein said adhesive tape covers at least substantially three quarters of said undersurface of said absorbent layer of material.

15. The garment shield as defined in claim 14 wherein said predetermined length is less than 10 inches and said predetermined width is less than 8 inches.

16. The garment shield as defined in claim 15 wherein there are at least four of said spreadable incisions, each of said incisions being approximately 0.5–2 cm in length.

17. The garment shield as defined in claim 16 wherein said absorbent layer of material is approximately 1–5 mm in thickness.

18. The garment shield as defined in claim 1 wherein the overall shape of shield is substantially oval.

19. The garment shield as defined in claim 1 wherein the overall shape of shield is substantially rectangular.

20. The garment shield as defined in claim 1 wherein said indentations are curved and void of any sharp edges.

* * * * *